US005174186A

United States Patent [19]

Baba et al.

[11] Patent Number: 5,174,186

[45] Date of Patent: Dec. 29, 1992

[54] ANVIL SURFACE FOR A ROTARY DIE CUTTER

[75] Inventors: Yasuyuki Baba; Arifumi Okamoto; Hiroshi Morinaga, all of Hiroshima, Japan

[73] Assignee: Mitsubishi Jukogyo Kabushiki Kaisha, Tokyo, Japan

[21] Appl. No.: 742,407

[22] Filed: Aug. 8, 1991

[30] Foreign Application Priority Data

Aug. 17, 1990 [JP] Japan ..... 2-86294[U]

[51] Int. Cl.[5] ..... B26D 1/56; B26D 7/20

[52] U.S. Cl. ..... 83/347; 83/659; 83/698

[58] Field of Search ..... 83/346, 347, 659, 658, 83/698; 101/415.1

[56] References Cited

U.S. PATENT DOCUMENTS 3,430.560 3/1969 Nettleman ..... 83/347 X
3.495.491 2/1970 Nungesser et al. ..... 83/346
3.618.438 11/1971 Simson ..... 83/347 X
3,981,213 9/1976 Lopman ..... 83/346
4,742,769 5/1988 Zeller ..... 101/415.1
4,848,204 7/1989 O'Connor et al. ..... 83/659

FOREIGN PATENT DOCUMENTS 332952 6/1903 France .
2133734 8/1984 United Kingdom .

*Primary Examiner*—Frank T. Yost
*Assistant Examiner*—Clark F. Dexter
*Attorney, Agent, or Firm*—Rothwell, Figg, Ernst & Kurz

[57] ABSTRACT

A rotary die cutter includes a rotatable anvil cylinder; and a knife cylinder made rotatable in a face-to-face relation to and in synchronism with the anvil cylinder and having knives fixed on the cutter circumference thereof for subjecting a sheet running at the central portions of the two cylinders to a predetermined cutting treatment by clamping the same together with the anvil cylinder. A thin film having a tape adhered thereto is attached removably to the outer circumference of the anvil cylinder in registration with the corresponding edges of the knife cylinder.

2 Claims, 2 Drawing Sheets

ANVIL SURFACE FOR A ROTARY DIE CUTTER

BACKGROUND OF THE INVENTION

1. Field of the Invention

The present invention relates to a rotary die cutter to be installed in a corrugated board boxing machine.

2. Description of the Prior Art

Before entering into a detailed description of the present invention, cursory review will be made on the existing general types of the rotary die cutter with reference to FIGS. 8 and 9. This rotary cutter is a machine for punching or ruling a corrugated board 1, which has been printed at a preceding step by a printer, into a predetermined form corresponding the specifications of a box to be manufactured.

This machine is constructed, as shown in FIG. 1, of a pair of erection frames 13*a* and 13*b* which are erected at the two widthwise ends of the boxing machine and connected through an upper stay 11 and a lower stay 12. In the frame 13*a* and 13*b*, there are borne an anvil cylinder 5 and a knife cylinder 2 which is juxtaposed in a lower position to the former cylinder 5. These two cylinders 5 and 2 are caused to rotate in a face-to-face relation to and in synchronism with each other through both gears 14 and 15 at their shaft ends and not-shown gear drive means. A pair of feed rolls 16*a* and 16*b* are disposed upstream of those cylinders 5 and 2, and cutting knives 4 or creaser knives are attached to the outer circumference of the aforementioned knife cylinder 2 through an edge anchor bed 3.

In the structure thus far described, the corrugated board 1 is sequentially delivered from the printing unit of the preceding step by the actions of the feed rolls 16*a* and 16*b* so that it can be subjected to a predetermined treatment such as the punching or ruling treatment by the clamped rotations of the anvil cylinder 5 and the knives 4 or the creaser knives fixed on the knife cylinder 2.

Next, the cutting function will be described in the following. Generally speaking, the basic structure of the rotary cutter for cutting the corrugated board 1 into a predetermined shape are classified into the two types, as shown in FIGS. 8 and 9. The structure of FIG. 8 is called the "soft cut" type, in which the knife cylinder 2 having the cutting knives 4 fixed on its outer circumference through the edge anchor bed 3 is combined with the anvil cylinder 5 having its outer circumference covered with a shock absorber 17 of urethane rubber or the like. The cutting knives 4 are caused to pierce the corrugated board 1 and to have their edges bite into the shock absorber 17 of the anvil cylinder 5 thereby to cut the corrugated board 1. According to this type, the cutting knives 4 can be prevented from wear and can have their edge bites set roughly to some extent by the shock absorber 17. Thus, this type is advantageous in that it can adjust the parallelism and shaft distance between the anvil cylinder 5 and the knife cylinder 2. Since, however, the knives 4 are caused to bite into the shock absorber 17, there arises a disadvantage that the punching lengths of the corrugated board 1 are varied due to the difference in the bite (usually of 1.0 to 2.5 mm) caused by the soft nature of the material of shock absorber 17.

Next, the structure of FIG. 9 is called the "hard cut" type, in which the knife cylinder 2 having the cutting knives 4 fixed on its outer circumference through the edge anchor bed 3 is combined with an anvil cylinder 5 having no shock absorber 17, i.e., having an iron surface. Thus, the corrugated board 1 is cut by bringing the cutting knives 4 into contact with the outer circumference of the anvil cylinder 5 or by pushing them under a proper pressure. This type is advantageous in that the punching precision is improved because the cutting knife edges and the anvil cylinder surface have their circumferential rotation speeds equalized.

Since, however, the surface hardness of the anvil cylinder 5 is set at a higher level than that of the edges of the cutting knives 4, the edges may wear to lose their sharpness or may be broken if the knives 4 are adjusted to be forced onto the anvil cylinder 5. Another difficulty of failure to cut the corrugated board 1 takes place if the edges of the knives 4 have a low contact pressure. For these reasons, it is seriously difficult to adjust the parallelism and gap (or engagement) between the edges of the cutting knives 4 and the surface of the anvil cylinder 5.

The rotary die cutters of the prior art, as exemplified in FIGS. 8 and 9, have the above-specified advantages and disadvantages individually. Incidentally, the following counter-measures have been taken at present for eliminating the disadvantages of the hard cut type.

As shown in FIGS. 6 and 7, there is adopted a method for punching the corrugated board by manually adhering a tape (having a thickness of about 0.01 to 0.02 mm) directly to the outer circumference of the anvil cylinder 5 in a manner to correspond to the layout of the knives 4 of the edge anchor bed 3 thereby to cause the edges of the knives 4 to bite into the tape 10. Thus, the punching precision of the board is maintained at an improved level, and the adjustment of the engagement of the cutting knife edges is facilitated.

However, the counter-measures of the prior art have to be adhered each time of an order change to the anvil cylinder 5 juxtaposed in conformity with the arrangement of the knives 4 of the edge anchor bed 3. Moreover, these works are not only dangerous under a restricted narrow circumstance but also troublesome in preparations so that they are major causes for dropping the operating efficiency, i.e., the productivity.

As has been described hereinbefore, most of the rotary die cutters adopt the hard cut type, in which the cutting knives fixed on the knife cylinder are brought into direct engagement with the outer circumference of the juxtaposed anvil cylinder of iron, with a view to improving the dimensional accuracy in the punching treatment. Since, however, this system requires a high technology for adjusting the engagement of the edges, there is adopted the simplified method of applying the thin tape to the outer circumference of the anvil. According to this method, the tape is adhered directly to the outer circumference of the anvil cylinder in a manner to correspond to the layout of the cutting knives fixed to the pairing knife cylinder. These works are accomplished inefficiently within the narrow space and take a long time for the adhesions so that they are major causes for blocking the improvement in the productivity.

SUMMARY OF THE INVENTION

It is, therefore, an object of the present invention to provide a rotary die cutter which is freed from the disadvantages specified above.

In order achieve the above-specified object, according to the present invention, there is provided a rotary die cutter comprising: a rotatable anvil cylinder; and a knife cylinder made rotatable in a face-to-face relation to and in synchronism with said anvil cylinder and having knives fixed on the outer circumference thereof for subjecting a sheet running at the central portions of the two cylinders to a predetermined cutting treatment by clamping the same together with said anvil cylinder, wherein the improvement comprises a thin film having a tape adhered thereto and attached removably to the outer circumference of said anvil cylinder in registration with the corresponding edges of said knife cylinder.

In the present invention, the tape can be adhered, for a subsequent order and outside of the machine, to the thin film to be wound on the outer circumference of the anvil cylinder. In case of an order change, therefore, it is sufficient to replace the film of the old order with the prepared new film. Moreover, the aforementioned preparations are worked outside of the machine so that they can be accomplished in parallel with the productions of the prevailing order. As a result, the safety of the works can be warranted, and the intermission of the machine for the order change can be remarkably shortened. Thus, it is possible to improve the productivity and to prevent the wear of the cutting knives thereby to elongate their lifetimes.

DESCRIPTION OF THE PREFERRED EMBODIMENTS

Figure 1:
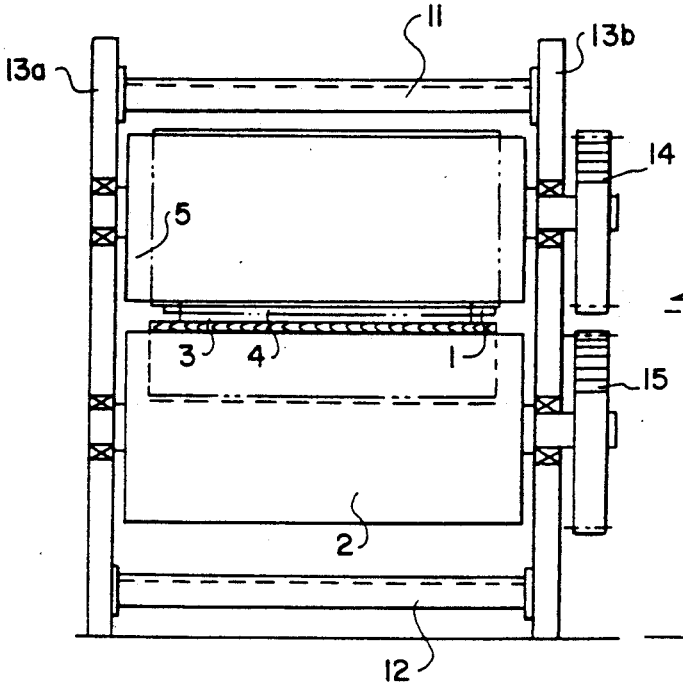
FIG. 1 is a front elevation showing a rotary die cutter according to the present invention.

The present invention will be described in the following in connection with a rotary die cutter according to one embodiment thereof, as shown in FIGS. 1 to 5. The rotary die cutter of FIGS. 1 to 5 is installed in a corrugated board boxing machine and has basic functions similar to those described in connection with the prior art in that it punches the corrugated board 1, which has been printed at a preceding step by the printer, into a predetermined shape and rules it, as necessary for being bent. The rotary die cutter of the present invention contemplates to improve the function of the anvil cylinder 5 which is to come into engagement with the cutting knives 4 fixed on the knife cylinder 2 through the edge anchor bed 3.

Figure 2:
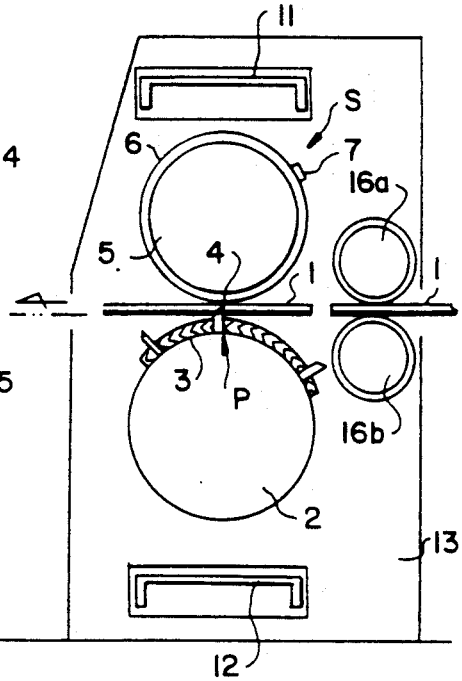
FIG. 2 is a side elevation of the same.
Figure 4:
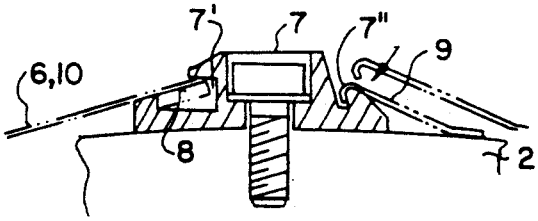
FIG. 4 is a detailed side elevation showing an S portion of FIG. 2.
Figure 5A:
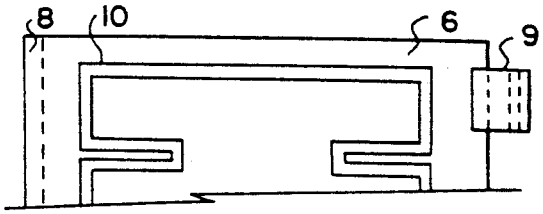
FIGS. 5A and 5B are explanatory views showing the adhered state of a tape to a thin film in accordance with the present invention.
Figure 5B:
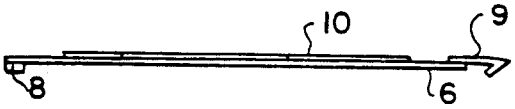
Figure 6:
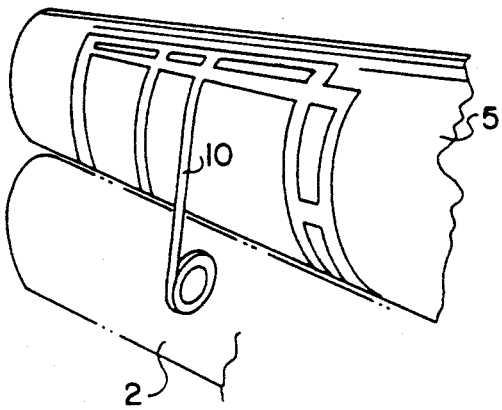
FIG.6 PRIOR ART
FIG. 6 is a perspective view showing the state in which the tape is adhered to the anvil cylinder of the prior art.
Figure 7:
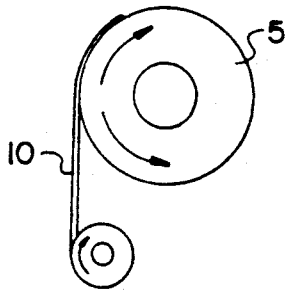
FIG.7 PRIOR ART
FIG. 7 is a side elevation of the same.

On the outer circumference of the anvil cylinder 5 of the rotary die cutter, as shown in FIGS. 1 and 2, there is provided fixing means 7 for fixing a thin film 6 in an axial direction, as exemplified in FIG. 4. The thin film 6 is equipped, as better seen from FIG. 5, with a fixing projection 8 at its one side end and a hook 9 at its other side end. The aforementioned fixing means 7 is formed with a recess 7' and a groove 7'', which are to be engaged by the fixing projection 8 and hook 9 of the thin film 6, respectively. Thus, the thin film 6 can be easily attached to and detached from the anvil cylinder 5 by bringing the fixing projection 8 and the hook 9 into and out of engagement with the recess 7' and the groove 7'', respectively. To the thin film 6, there is adhered the tape 10 in a manner to correspond to the layout of the knives 4 which are fixed in the edge anchor bed 3. Thus, the tape 10 can be replaced together and in combination with the edge anchor bed 3 when the production order is to change.

Figure 3:
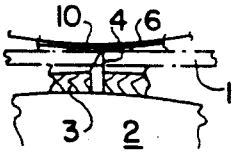
FIG. 3 is a detailed side elevation showing a P portion of FIG. 2.
Figure 8:
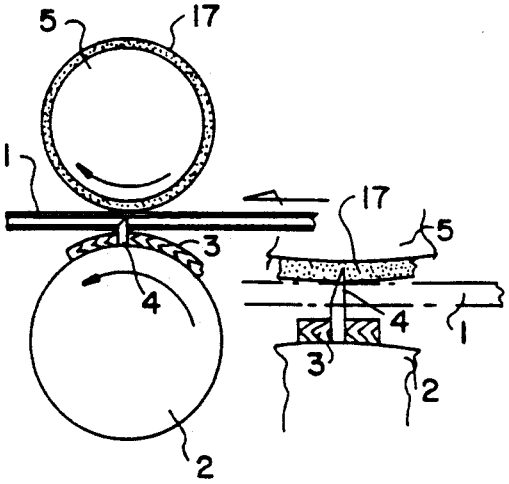
FIG.8 PRIOR ART
FIGS. 8 and 9 are explanatory views respectively showing the cut states of the corrugated boards by the rotary die cutters of the prior art.
Figure 9:
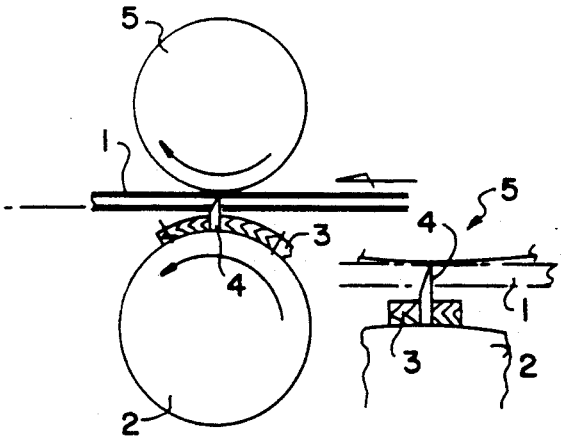
FIG.9 PRIOR ART

The works of adhering the tape 10 to the thin film 6 can be outside of the machine during the run (or production) of the prevailing order in accordance with the specifications of the product board of a subsequent order. The replacement of the film 6 may be effected merely by substituting the film of the preceding order so that the drop in the operating efficiency of the rotary die cutter can be reduced. Moreover, the engagement between the anvil cylinder 5 wound on the thin film 6 and the knives 4 fixed on the outer circumference of the knife cylinder 2 through the edge anchor bed 3 is adjusted such that the edges of the knives 4 slightly bite into the tape 10, as shown in FIG. 3. Thus, the present invention can facilitate the adjustment of the gap between the edges of the knives 4 and the outer circumference of the anvil cylinder 5 to some extent, although the adjustment has been difficult in the hard cut system shown in FIG. 9. In addition, the present invention can eliminate the drop in the punching precision, which has been a disadvantage of the soft cut system shown in FIG. 8. In short, the present invention can not only establish the functional effect of the adhesion of the tape 10 to the outer circumference of the anvil cylinder 5 but also remarkably shorten the time period for the resetting works for an order change, so as to eliminate the disadvantages of the rotary die cutter of the prior art shown in FIGS. 8 and 9.

On the other hand, the fixing means for fixing the film 6 on the anvil cylinder 5 may be exemplified in various manners by the means for mounting the plate on the bed of a printer.

Since the present invention is constructed, as has been described in detail hereinbefore, the thin film having the tape adhered thereto can be prepared in advance for the knife layout of the edge anchor bed so that the thin film of the old order on the anvil cylinder may be replaced for an order change with that new one. Since, moreover, the thin film having the tape adhered thereto is applied to the outer circumference of the anvil cylinder, the adjustment of the gap between the anvil cylinder and the knives engaging with the cylinder can be rather roughly set. In addition, the bites of the knife edges into the tape are small so that the drop in the punching precision can be reduced while elongating the lifetimes of the cutting knives. Thus, according to the present invention, it is possible to shorten the setting change for an order change and to produce corrugated boards of high quality.

What is claimed is:

1. A rotary die cutter, comprising:

a rotatable anvil cylinder;

a knife cylinder having knives fixed on an outer circumference thereof in a predetermined configuration, said knife cylinder being disposed in face-to-face contacting relationship with said anvil cylinder and being rotatable in synchronism with rotation of said anvil cylinder, for subjecting a sheet moving therebetween to a predetermined cutting process; and a thin film removably attached to an outer surface of said anvil cylinder, said thin film having a predetermined tape pattern adhered thereto on a surface facing said knife cylinder, said predetermined tape pattern corresponding to said predetermined configuration of said knives so that said knives contact said tape pattern during said cutting process.

2. A rotary die cutter according to claim 1, further comprising:

fixing means mounted in the axial direction on the outer surface of said anvil cylinder; and engagement means formed on both side ends of said thin film for engaging removably with said fixing means to fix said thin film removably on the outer circumference of said anvil cylinder.

* * * * *